US008990927B2

(12) United States Patent
Al-Azzawi

(10) Patent No.: US 8,990,927 B2
(45) Date of Patent: Mar. 24, 2015

(54) LOCK WITH NEW FEATURE

(76) Inventor: Jasim Seleh Al-Azzawi, Falls Church, VA (US)

( * ) Notice: Subject to any disclaimer, the term of this patent is extended or adjusted under 35 U.S.C. 154(b) by 1540 days.

(21) Appl. No.: 11/450,476

(22) Filed: Jun. 12, 2006

(65) Prior Publication Data

US 2008/0034422 A1 Feb. 7, 2008

(51) Int. Cl.
*G07C 9/00* (2006.01)

(52) U.S. Cl.
CPC ..... *G07C 9/00182* (2013.01); *G07C 9/0069* (2013.01); *G07C 9/00896* (2013.01); *G07C 2009/00793* (2013.01)
USPC ..... 726/19

(58) Field of Classification Search
USPC ..... 726/19, 34
See application file for complete search history.

(56) References Cited

U.S. PATENT DOCUMENTS 6,950,202 B1 * 9/2005 Kikugawa ..... 358/1.15
2004/0108938 A1 * 6/2004 Entrekin ..... 340/5.73
2006/0112279 A1 * 5/2006 Cohen et al. ..... 713/186
2006/0232376 A1 * 10/2006 Blaker ..... 340/5.22
2007/0197261 A1 * 8/2007 Humbel ..... 455/558

FOREIGN PATENT DOCUMENTS

WO WO/2005/091182 * 9/2005

* cited by examiner

*Primary Examiner* — Lisa Lewis
(74) *Attorney, Agent, or Firm* — Moore Patents; David Dreyfuss; Cynthia R. Moore

(57) ABSTRACT

We make door locks which has a receiver it can be locked or opened via receiving a password as long sequence of numbers when transmitted to it from the cellular phone where each lock when it is sold a plastic card comes with it containing password when we scratch and reveal the password and we input it in the cellular phone and save it, then the door lock will open when we press a button on the cellular phone and will be locked when we press the button again, as well the cars come with a plastic card and the same is done as explained before so by the cellular phones we can lock and unlock the car, the same can be done for the garage gate and office doors, ATM card will be replaced by a password saved in the cellular phone as explained above.

12 Claims, No Drawings

LOCK WITH NEW FEATURE

BACKGROUND OF THE INVENTION

This invention is in the field of locks where a new feature will be added to the locks.

The average man now a days carry with him home key, car key, office key or electronic card to enter the office with, and ATM card for drawing cash from the ATM cash machine and credit card. This invention will make a person not to carry any of these things any more he/she only carry with him/her the cellular phone only because all of these and more will be in the cellular phone.

BRIEF SUMMARY OF THE INVENTION

We add to the cellular phones new capabilities where this cellular phone will be able to save a sequence of a long number and many different sequences of these numbers each one of these sequences can be transmitted separately by selecting it via a push button or a soft key.

At the same time we make door locks which have a receiver, it can be locked or opened via receiving a password as long sequence of numbers when transmitted to it from the cellular phone where each lock when it is sold a plastic card comes with it containing many passwords when we scratch and reveal the first sequence of a long number, and we input it in the cellular phone and save it then the door lock will open when we press a button on the cellular phone and the door lock will be locked when we press the button on the cellular phone once again because the door lock receives the correct password.

As well the cars come with a plastic card and the same is done as explained before so by the cellular phones we can lock and unlock the car door.

About the ATM card from now on the user receives a plastic card from the bank containing many passwords when he/she scratch and reveals the first sequence of a long number and he/she inputs it in the cellular phone and save it then when he/she press the button related to this password the ATM cash machine asks for the manual four digit password then the money is delivered, so it will work just as before except the people will not carry the ATM card the cellular phones will function as one.

BRIEF DESCRIPTION OF THE SEVERAL VIEWS OF THE DRAWINGS

There are no drawings.

DETAILED DESCRIPTION OF THE INVENTION

This invention will make the cellular phones function as home key, car key, office key, electronic card to enter the office with, ATM card for drawing cash from the ATM cash machine, and credit card. This invention will make a person not to carry any of these things any more he/she only carry with him/her the cellular phone because all of these things and more will be in the cellular phone.

We make door locks for the gates, home doors, safe doors, garages, office doors, and factories etcetera where it has an electronic circuitry and a receiver where this lock can be locked or opened via receiving a password as long sequence of numbers when transmitted to it from the cellular phone where each lock when it is sold a plastic card comes with it contains many passwords, when we scratch and reveal the first sequence of a long number, it can be combination of numbers and letters, and we input it in the cellular phone and save it, so when we transmit this password to the lock by pressing a button on the cellular phone the door lock will open and when we press the button again the cellular phone transmit the password to the lock and the lock receives it and the door lock will be locked.

The additional passwords on the plastic card are for back up when some one sees the first password the owner can scratch the second password and insert it in the cellular phone and when he/she uses it once the first password will be obsolete not usable any more, this is done for security reasons so the user will not be stuck with one password if the first password is revealed to some one by mistake.

The lock has the capability of adding to it temporary passwords used by the other members of the family and visitors this feature will be much appreciated by the hotels, where via this capability of the lock lets name it phone activated lock a hotel can add other passwords to the phone activated lock by activating the lock to this feature by pressing a button on the lock then transmitting to it the original password from the cellular phone so this feature will be active, so the owner of the lock start to enter one password or two or more then he/she presses the button again these passwords will be saved on the phone activated lock, so any visitor to a hotel when he/she comes they ask for his/her cellular phone and they save this password on his/her cellular phone and preferably they transmit the password to his/her cellular phone so the visitor will use his/her cellular phone to go in the room while he/she is still a resident in the hotel, when he/she leaves the hotel, the hotel deletes this password so no one can get in by using this particular password, this feature will be used for home visitors and office workers and factory workers so when they leave work or resign their password will be deleted so they can not use these passwords to get in by using these particular passwords again.

It is preferable that each phone activated lock has a memory where each time the lock is opened or locked the memory will register the time and date of all the people come in or go out so the owner of the lock can see who came in and out and when, where the owner of the phone activated lock gives each temporary password the name of the person that he saved it in his/her cellular phone, so the name will be revealed plus the time and the date.

It is preferable too that another option is available in the phone activated lock where a delete time and date can be added beside each temporary password so this temporary password will be automatically deleted or deactivated at that certain time and date so this particular person will not be able to use his temporary password any more, certainly this option is optional and the hotels will use it so the resident if he/she reserved for one week for example automatically he/she can not go in the room unless he/she contact the reception to reserve more days.

It is preferable too that the temporary passwords has an option which makes it usable for one time only after that this particular password will be useless, so when selecting this option for a password this password will open the phone activated lock one time only then it will be deleted from the memory of the phone activated lock so no one can use this password twice, this option will be useful in the large steel containers used to export goods from one country to another where the company owning these steel containers puts in each phone activated lock so many one time useable passwords plus it sticks the telephone number of the company on every phone activated lock so when the port authority wants to search any of these steel containers it phones the owner company and asks for the password after using this password and opening the steel container and searching it for drugs for example the authority locks the steel container and after that no one else can open the steel container using this particular password because it is usable for one time only.

Since the phone activated lock registers the date and time of opening and locking of each lock, so the owner company will know the date and time of the opening and locking of the steel container and from that the duration of the search.

It is preferable too that the phone activated lock used in the steel containers has a magnetic card reader where every port inspector should have one of these magnetic cards where the data on the card includes the port name plus the inspector name, so the company owning this steel containers will know the name of the port and the inspector who made the search besides the date and time of the opening and locking of the steel container.

To limit the users to one cellular phone, we make the cellular phones so that each cellular phone has cellular phone identity number so when the user uses his/her cellular phone to open the lock for the first time the lock remembers the cellular phone's identity number too, so from now on the lock will not open unless the unlock password comes from this particular cellular phone where we design the cellular phones so it transmit the password first than it transmit the cellular phone identity number. This is optional the owner can activate the cellular phone identity number on the phone activated lock or not activated it, so when it is not activated, the phone activated lock will open the door to any cellular phone transmitting this password to it.

The cellular phones from now on should have cellular phone identity number it will be transmitted with every call and with every message and with every password and this feature can not be deactivated at all not by any body, it is built in the circuitry of the cellular phones.

The bank from now on besides giving the customer the ATM cash card to use it to draw money from the ATM cash machine it also gives the customer a plastic card containing many passwords when he/she scratch and reveal the first password and he/she inputs it in the cellular phone and save it, then when he/she press the button related to this password in front of the ATM cash machine the password will be transmitted from the cellular phone to the ATM cash machine, then the ATM cash machine asks for the manual four digit password then the money is delivered, so it will work just as before except the people will not carry the ATM card the cellular phone will function as one, so the people will not carry the ATM cash card with them from now on they keep it at home just as a backup.

About the Credit card The bank from now on besides giving the customer the Credit card to use it to pay instead of using money when shopping or at the petrol station or when hiring a taxi etcetera, it also gives the customer a plastic card containing many passwords, when he/she scratch and reveal the first password and he/she input it in the cellular phone and save it, then when he/she press the button related to this password in front of the Credit card device the password will be transmitted from the cellular phone to the Credit card device, then the Credit card device asks for the manual four digit password then the money is transferred to the account of that shop electronically, so it will work just as before except the people will not carry the Credit card the cellular phone will function as one so the people will keep the Credit card at home just as a backup.

So from now on every person can carry his home key, second home key, parents home key, friends home keys, relatives home keys, hotel room key, garage gate key, locker key, his safe key, his company or factory main door key, his office door key, his car key, his wife's car key, his son's or friend's car keys, hired car key, his company's car key, plus the ATM card for drawing cash from the cash machine and credit card, where all these are in his/her cellular phone as soft keys as passwords. So this invention will make live very easy for all people.

From now on this invention will be used in lorries, Tractors, airplanes, DHL containers, large steel containers used to export goods from one country to another, factory machines so only authorized workers can operate them and for large computers and servers so only authorized workers can operate them and many other equipments and devices and machines even elevators.

It is preferable that each cellular phone when it is sold another device will be accompanied with it, the device can be carried in the bag or hanged on the belt or held round the wrist like the wristwatch, since this device will function as password saver and transmitter only, it will be very small it will almost be invisible when attached to the belt and it can be combined with a wristwatch so the person will have an ordinary wristwatch plus this invention is built within it, so if a person losses his/her cellular phone or forgets it he/she can use his/her wristwatch for opening doors and drawing cash. I personally prefer that two backups are supplied with each cellular phone, one can be attached to the belt and the other as a wristwatch can be fastened around the wrist.

To make it easy for the user these backups devices can be loaded by the new passwords from the cellular phone by transmitting the new passwords from the cellular phone to these backups devices without the need to waste time by entering these passwords in all these devices one by one each separately.

It is preferable that a password can be created by the owner to this feature on the cellular phone so no one can open this feature on the cellular phone or on the backup devices even if the cellular phone fell in strangers hands, therefore only the owner can use this feature since he/she is the only one who knows the password to this feature, because he/she created the password, while the telephone part of the cellular phone is still usable any time without a password, only this feature we need the password to open it, so if the cellular phone fell in any strangers hands this stranger can not open the doors or the car or any thing since he/she does not know the owners password.

The best mode for carrying out this invention is to make the phone activated lock capable of adding to it temporary passwords to be used by the other members of the family and visitors plus having multi original passwords where they come on a card buried under a nontransparent film. As well best mode for the cellular phones that they are capable of saving and transmitting passwords for a person's home lock, second home lock, parents home lock, friends home lock, relatives home lock, hotel room lock, garage gate lock, locker lock, his safe lock, his company or factory main door lock, his office door lock, his car lock, his wife's car lock, his son's or friend's car lock, hired car lock, his company car lock, and more plus the ATM card for drawing cash from the cash machine.

The industrial applicability of this invention will be great since all the people will change their locks to the phone activated lock and all the new buildings will install this phone activated lock because locks represent a very small fraction of the total cost of the building but it will make the building an advanced building and easy to use easy to rent and sale. This kind of cellular phones will be manufactured by great numbers and the sale will be great too, since every one will love to buy this kind of cellular phones so to get rid of the agony which been created by carrying many keys and cards.

The invention claimed is:

1. An electronic lock system comprising a plurality of electronic locks capable of locking and unlocking upon receipt of coded passwords, and a programmable mobile wireless transmitting device capable of storing and transmitting a plurality of said coded passwords;

wherein each of said electronic locks is sold with a set of said coded passwords capable of being entered into said programmable mobile wireless transmitting device, and wherein each of said coded passwords can be used to lock and unlock its associated electronic lock;

wherein if a coded password not previously used is received by one of said electronic locks, any previously used coded password becomes invalid for locking and unlocking said electronic lock; and wherein said electronic locks are used for at least two different applications selected from a list comprising home doors, gates, office doors, car doors, garage doors, and safes.

2. The electronic lock system of claim 1, wherein said programmable mobile wireless transmitting device is a cellular telephone.

3. The electronic lock system of claim 1, wherein an authorized user of one of said electronic locks can create and delete a temporary coded password with an optional automatic expiration date and time, wherein said temporary coded password is capable of being entered into said programmable mobile wireless transmitting device.

4. The electronic lock system of claim 1, wherein one or more of said electronic locks has associated memory to record each use of said electronic lock.

5. The electronic lock system of claim 4, wherein said programmable mobile wireless device also transmits an ID code which is recorded in said associated memory with each use of said electronic lock.

6. The electronic lock system of claim 1, further comprising electronic locks for one or more of additional homes, hotel rooms, additional cars, trucks, tractors, airplanes, factory machines, equipment, shipping containers, elevators, and computers.

7. The electronic lock system of claim 1, further comprising an automatic teller machine (ATM) capable of receiving coded passwords from said programmable mobile wireless transmitting device, wherein said programmable mobile wireless transmitting device is further capable of storing and transmitting a coded password associated with an ATM card, and wherein said ATM is capable of retrieving the card number associated with said ATM card.

8. The electronic lock system of claim 1, further comprising a credit card reader capable of receiving coded passwords from said programmable mobile wireless transmitting device, wherein said programmable mobile wireless transmitting device is further capable of storing and transmitting a coded password associated with a credit card, and wherein said credit card reader is capable of retrieving the card number associated with said credit card.

9. The electronic lock system of claim 1, wherein said programmable mobile wireless device also transmits an ID code, wherein at least one electronic lock records said ID code and associates it with a valid coded password on first receipt, and wherein said coded password is accepted as valid on subsequent receipt only if accompanied by the same ID code.

10. An electronic lock system comprising an electronic lock capable of locking and unlocking upon receipt of coded passwords, a programmable mobile wireless transmitting device capable of storing and transmitting a plurality of said coded passwords, wherein said electronic lock is programmed with a set of one-time-use coded passwords which allow said electronic lock to be opened only once with each coded password.

11. The electronic lock system of claim 10, wherein said electronic lock is used on a shipping container.

12. The electronic lock system of claim 10, wherein said programmable mobile wireless device also transmits an ID code, wherein said electronic lock records said ID code and associates it with a valid coded password on first receipt, and wherein said coded password is accepted as valid on subsequent receipt only if accompanied by the same ID code.

* * * * *